United States Patent [19]

Haldeman, III

[11] 3,946,349

[45] Mar. 23, 1976

[54] HIGH-POWER, LOW-LOSS HIGH-FREQUENCY ELECTRICAL COIL

[75] Inventor: Charles W. Haldeman, III, Concord, Mass.

[73] Assignee: The United States of America as represented by the Secretary of the Air Force, Washington, D.C.

[22] Filed: Aug. 3, 1973

[21] Appl. No.: 385,363

Related U.S. Application Data

[63] Continuation-in-part of Ser. No. 139,400, May 3, 1971, abandoned.

[52] U.S. Cl. ..... 336/62; 29/605; 174/15 C; 174/114 R; 219/10.79; 260/33.4 P; 264/317; 336/205

[51] Int. Cl. ..... H01f 27/10

[58] Field of Search ..... 336/62, 60, 55, 96, 205, 336/222; 174/15 C, 114 R; 219/10.79; 29/605; 264/317; 260/33.4 P

[56] References Cited

UNITED STATES PATENTS

| | | | |
|---|---|---|---|
| 2,817,066 | 12/1957 | Searpa | 336/62 X |
| 2,988,804 | 6/1961 | Tibbetts | 29/605 |
| 3,535,597 | 10/1970 | Kendrick | 336/62 X |

FOREIGN PATENTS OR APPLICATIONS

| | | | |
|---|---|---|---|
| 762,111 | 6/1967 | Canada | 174/15 C |
| 229,454 | 9/1959 | Australia | 174/15 C |

*Primary Examiner*—Thomas J. Kozma
*Attorney, Agent, or Firm*—Joseph E. Rusz; James S. Shannon

[57] ABSTRACT

High frequency electrical coils are commonly made out of Litz wire. If the coil is baked and an aqueous phenoi solution is pumped through a nylon tube making up the structural core of the Litz wire, the tube will be dissolved out, thereby yielding an unobstructed opening through which a cooling fluid may be pumped. The resultant coil has a vastly improved heat conduction and can tolerate substantially higher currents.

10 Claims, 6 Drawing Figures

HIGH-POWER, LOW-LOSS HIGH-FREQUENCY ELECTRICAL COIL

This invention was made in the course of work performed under a contract with U.S. Air Force Systems Command, Office of Aerospace Research.

This is a continuation-in-part of application Ser. No. 139,400 filed May 3, 1971, now abandoned.

PRIOR ART

Litzendraht, or Litz cable is commonly used to make up high-power, low-loss, high-frequency electrical coils. Applications for such coils are common to radio transmitters, induction heaters, and plasma accelerators with operating frequencies up to a few megacycles. The cable is made up of bundles of fine insulated magnet wires spiraled or braided around a central core. The high number of individual wires is utilized to overcome the skin effect, the a.c. resistance at high frequencies in a solid conductor arising from the increasingly higher flux between the center and outside layer of the conductor. The center core of the Litz wire is the structural means of supporting the braided or spiral construction.

In order to produce a high magnetic field efficiently, a high coil Q and high current capacity are necessary. This is particularly important, for instance, in induction heater and plasma accelerator applications where high power is required, and in airborn radio transmitters where reduced weight of the coils is additionally important. The limiting factors with regard to high current are the structural tolerance of the coil and the resistance produced by heating. Hence, thermal conductivity of the coil is an important factor bearing on high power.

In order to accomplish cooling of the coil and thereby increase its thermal conductivity, Litz wire is constructed with a nylon tube core through which water or a cryogenic cooling fluid, such as dry ice and acetone, is pumped. Such techniques permit substantially increased currents, the limiting factor on heat dissipation being the thickness and low thermal conductivity of the wall of the nylon tube. Tubes of different construction are available, such as copper, with high heat dissipation, but while they are advantageous in this respect, they are correspondingly good electrical conductors and hence lower the Q of the coil. Some prior-art patents are now discussed.

United States patent No. 2,988,804 (Tibbetts) discloses that plastic cores (Polystyrene) can be removed by solvents from small, short length/diameter l/d 1 to 3) coils by dissolving away such cores in organic solvents; and U.S. Pat. Nos. 2,614,999 (Caldwell) and 2,360,406 (Dreyfus et al.) disclose suitable solvents for Nylon plastic. Simple use of these methods, however, cannot be made in the case of removing the core from a large length of tubing e.g., in the present situation 10 to 20 feet of 0.090 inch inside diameter with l/d = 1000 to 3000 (1600 for the example hereinafter given). The geometry is paramount because of the fact that when polymers dissolve in solvents they swell first, producing a layer of very high viscosity, low solvent content solution at the surface of the solid polymer. This layer will grow and unless the pumping velocity, rate of solution of polymer, and temperature are correctly chosen for the length to diameter ratio of the tube being removed, the result will be to permanently plug the tube, preventing further admission of solvent. The stagnant core of solvent, then proceeds to gel the entire length of the tube. It can easily be seen from the explanation in later paragraphs, that growth of a viscous boundary layer of high polymer content can close the tube. Further diffusion of polymer into the solvent then further increases the viscosity, eventually turning the entire core into a thick gel.

SUMMARY OF INVENTION

In view of the limitations on heat dissipation and current carrying capacities in electrical coils made out of Litz wires, it is applicant's primary purpose to construct a high-power, low-loss high frequency coil with heat dissipation greater than has heretofore been achieved. This and other objects are met by an electrical coil wound out of Litz wire having a clear, unobstructed channel through which a cooling fluid can be pumped. This coil is constructed by winding a coil out of Litz wire having a nylon tube core and dissolving said nylon tube with a solution which will not injure the insulation on the Litz wire or attack any metal in the Litz wire exposed by statistical voids.

Further objects and a better understanding of the invention will become more apparent with the following description taken in conjunction with the accompanying drawing in which.

PREFERRED EMBODIMENT

Figure 1A:
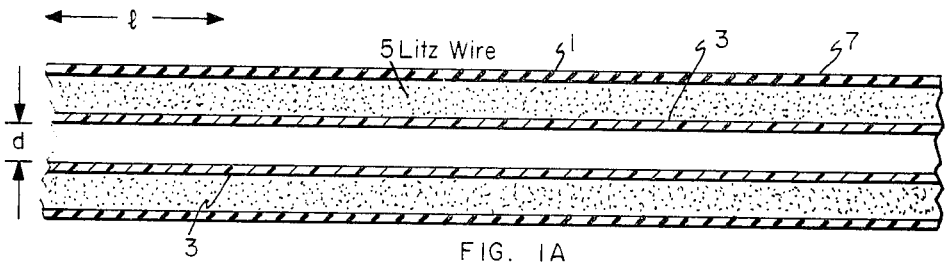
FIG. 1A is a section view, on a reduced scale, taken upon the line 1A—1A in FIG. 1, looking in the direction of the arrows.
Figure 1:
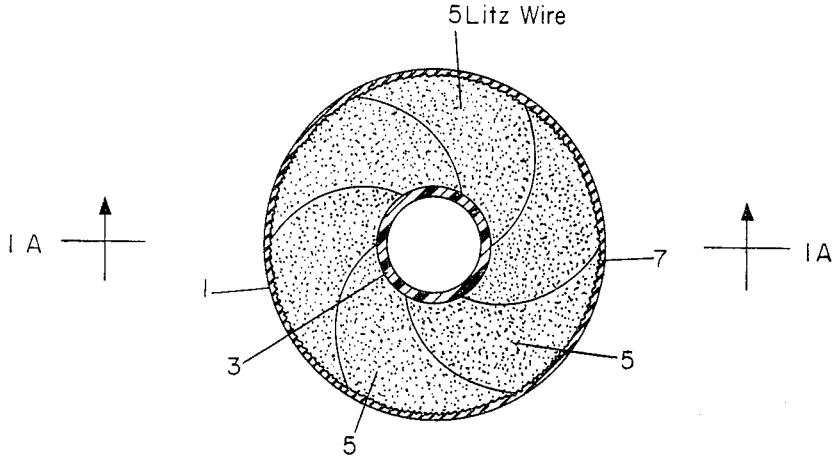
FIG. 1 is a cross-sectional view of a 12000/46 spiraled Litz wire with a nylon tube core.

FIG. 1 illustrates the typical construction of Litz cable 1 with a nylon tube 3. The cross-section of the particular cable shown is that of 12000/46 wire. The outside diameter is approximately 0.310 inches. There are six bundles 5 of wires each comprising approximately two thousand fine magnet wires with varnish insulation. The bundles are shown with a sprial-type construction. Litz wire commonly is made with a braided construction, but the principles taught herein apply in the same manner. The center core is a ⅛ inch diameter nylon tube 3 with a 1/32 inch wall thickness. The outside covering 7 is made up of braided fabric or silicone rubber.

Figure 2:
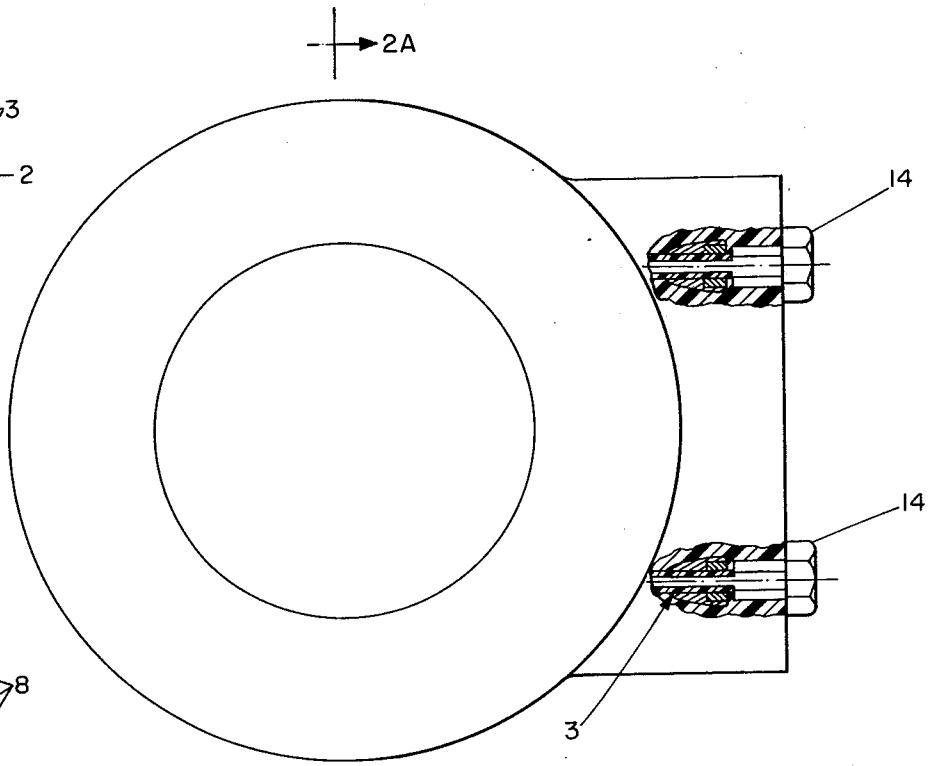
FIG. 2 is a sample, high-power, low loss electrical coil wound of Litz wire with a nylon core like the wire of FIG. 1.
Figure 2A:
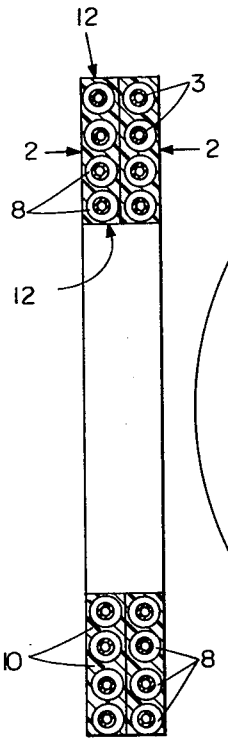
FIG. 2A is a section view taken upon the line 2A—2A in FIG. 2, looking in the direction of the arrows.

FIG. 2 illustrates a typical coil construction on a plasma accelerator. The cross-sectional view in FIG. 2A shows the coil to be made up of 10 turns of 12000/46 Litz wire 8 with nylon tube core 3. The coil is made by winding the Litz wire in place and imbedding it in an epoxy or polystyrene resin 10 with cloth overlay on all four surfaces 12 of the coil. A braided construction Litz wire is preferred as it produces a slightly higher Q than spiraled construction. Terminal compression fittings 14 act as electrical terminals and water connections. As stated above, the limiting factor with regard to heat dissipation is the wall thickness of the nylon tube 3 which inherently has a low thermal conductivity. The tube 3, of course, is necessary for structural support of the spiral or braided constructed Litz wire and is additionally important when winding the coil as the wire would collapse without a minimum internal support.

Figure 3:
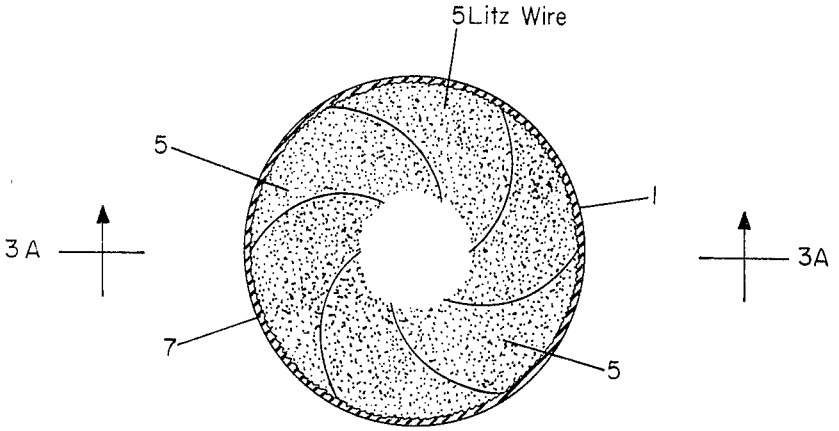
FIG. 3 is a cross-sectional view of the Litz wire of FIG. 1 but the nylon core has been removed.
Figure 3A:
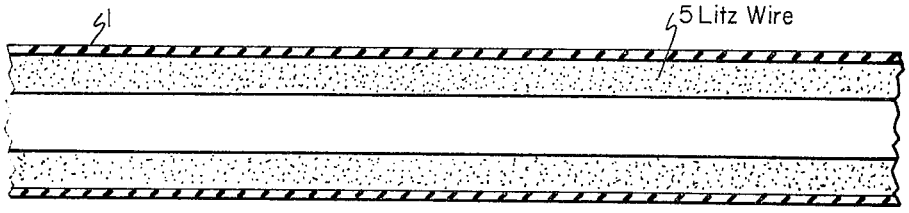
FIG. 3A is a section view, on a reduced scale, taken upon the line 1A—1A in FIG. 3, looking in the direction of the arrows.

Applicant has discovered that the nylon tube can be removed after the Litz wire 8 has been formed into the coil. This is accomplished by dissolving the tube 3 with a solvent and extracting the dissolved material in solution. One appropriate solvent is a strong aqueous phenol solution, e.g., 30 percent. The coil is heated to 200°F and maintained at this temperature while the solution is pumped through the Litz wire 8 via the terminal compression fittings 14. The purpose in maintaining the coil at 200°F is to prevent any dissolved nylon from precipitating out and plugging the tube 3 as the solution is cooled during its passage through the coil winding. A constant flow is maintained and completion of dissolution of the tube 3 can be determined by sampling the discharge solution, cooling it, and observing any precipitate. FIG. 3 illustrates a cross section of Litz wire with the tube 3 removed.

It is important in dissolving the nylon tube 3 to choose a solution which will only dissolve the nylon tube 3 and not the varnish insulation on the fine magnet wires. Equally important, the dissolving solution should not attack any copper exposed by statistical voids in the insulation, as this will result in lowering the Q of the coil.

After the tube 3 is removed, the Litz wire 8 and coil are structurally sound and there is no danger of the Litz wire 8 collapsing as it is imbedded in resin 10. If a proper cooling fluid is pumped through the resulting unobstructed channel, the coil can be operated with five times the previous maximum current capacity. The choice of a cooling fluid is restricted to a fluid which will not lower the Q of the coil if absorbed by the resin 10.

The current carrying capacity of 12000/46 Litz wire is increased to 50 ma per circular mill of cable as compared to 10 ma with cooling through the nylon tube. The following table illustrates the current capacity of the Litz wire with the nylon tube 3 in place and with the tube removed. For example, at 135°F with the tube in place, the d.c. current capacity through the coil is 330 amps and with the tube 3 removed and maintaining the same temperature, the coil has a capacity of 1040 amps. Since at the design frequency such coils can have a ratio of AC to DC resistance of about 1.1 the DC test is an adequate representation of power handling ability.

CURRENT CAPACITY AND RESISTANCE V. TEMPERATURE
12000/46 LITZ WIRE
200 PSI TAP WATER AS A COOLANT

With Nylon Tube 3 in Place

| D. C. Amps | Milliohms/ft. | T°F |
|---|---|---|
| 144 | .467 | 75 |
| 240 | .440 | 100 |
| 330 | .466 | 135 |
| 440 | .560 | 205 |
| 560 | .790 | 490 |

Nylon Tube 3 Removed

| D. C. Amps | Milliohms/ft. | T°F |
|---|---|---|
| 95 | .388 | 48 |
| 302 | .396 | 54 |

-continued

CURRENT CAPACITY AND RESISTANCE V. TEMPERATURE
12000/46 LITZ WIRE
200 PSI TAP WATER AS A COOLANT

With Nylon Tube 3 in Place

| D. C. Amps | Milliohms/ft. | T°F |
|---|---|---|
| 532 | .411 | 70 |
| 739 | .415 | 90 |
| 1040 | .446 | 133 |
| 1600 | .575 | 250 |

Another example of a method of constructing a coil made out of Litz wire without a center core is to utilize Litz wire with a thermally shrinkable center core. The coil would be wound and imbedded in resin as described above. The coil and the Litz wire with the thermally shrinkable core are heated to a temperature sufficient to contract the center core such that it can be removed mechanically. The shrinkable core is chosen with a temperature range between the curing temperature of the resin and the maximum service temperature.

A further example would be to utilize a Litz wire with a copper tube center core. This center tube core can be etched out with a ferric chloride solution similar to methods used in the printed circuit industry. However, the ferric chloride tends to attack the fine copper magnet wires in the Litz wire which are exposed in places due to statistical voids. This lowers the Q substantially, and the low-loss feature of such coils is correspondingly lost. If, however, the copper tube core was coated with an extremely thin coat of plastic insulation in the construction process in making the Litz wire, this problem is overcome and the low thermal conductivity of such a thin coating is an insignificant limitation on heat dissipation.

As is previously noted, the nylon tube 3, as best shown in FIG. 1A has a length-to-diameter ratio (l/d) that is quite large in any Litz wire of interest. The l/d in the coil of FIG. 2, for example is 1600; is typically the l/d is at least 1000 and certainly nothing less than an l/d of at least 50 is reasonable. In this circumstance, the nylon, once it starts to dissolve, must be kept flowing, or it will block the inner aperture in the Litz wire. As also previously noted, once the nylon core 3 has been removed, the Litz wire would collapse in the absence of measure to prevent this occurrence. In the coil of FIG. 2, the necessary structural support to prevent collapse of the Litz wire is furnished by the epoxy or polystyrene resin. If the conductor 1 is needed in the form of an elongate, flexible element, as shown in FIGS. 1A and 2A, the needed structural stability can be supplied by a covering 7 of silicone rubber (e.g., GE RTV-11 or Dow Corning RTV602) which impregnates the wire to produce a flexible but structurally sound cable. It will be appreciated that the spiraled Litz wire turns of the continuous spiral from the inside to the outside of the conductor, so that the structural stability can be applied to the outer surface.

One further point is of consequence. The compression fittings 14 can be a brass or copper tube compression fitting that serves both as an electrical terminal and as a hydraulic connector. A basic problem here is that the 12,000 strands of No. 46 wire have a large surface perimeter 5 feet for the 12000/46 coil discussed) so that the increase in resistance and heating at the current concentration is quite great. Thus, the particular connector is important.

Modifications of the invention herein described will occur to persons skilled in the art and all such modifications are considered to be within the spirit and scope of the invention as defined by the appended claims.

What is claimed is:

1. An improved high-power, low-loss, high-frequency electrical coil comprising:

a. at least one turn of Litz wire having a clear unobstructed center channel through which a cooling fluid may be pumped, there being no element between said Litz wire and said center channel, said wire being wound in a circular pattern, b. an electrical insulating material with mechanical strength in which the Litz wire is imbedded.

2. An improved high-power, low-loss, high-frequency electrical coil as recited in claim 1 in which said insulating material comprises a plastic resin.

3. An improved high-power, low-loss, high-frequency electrical coil as recited in claim 1 including means for making an electrical connection to said coil.

4. An improved high-power, low-loss, high-frequency electrical coil as recited in claim 1 including means for making a hydraulic connection to said unobstructed hollow center channel through which a cooling fluid may be pumped through said center channel.

5. An improved high-power, low-loss, high-frequency electrical conductor that comprises a Litz wire having an unobstructed hollow center channel with no element between said Litz wire and said hollow center channel, and a low-electrical-loss, high-dielectric insulating cover that provides a structurally sound housing to prevent collapse of the otherwise structurally unstable Litz wire.

6. An electrical conductor as claimed in claim 5 in which the insulating cover comprises a plastic material which impregnates the outer surface of the conductor, the wires at said outer surface being imbedded in the plastic material which provides the necessary mechanical strength to prevent collapse inwardly of the Litz wire and to provide a liquid impervious structure around and between the outer wires of the Litz wire, thereby to permit a cooling fluid to be pumped through said channel to be in intimate thermal contact with the individual current-carrying wires making up the Litz wire.

7. An electrical conductor as claimed in claim 6 that includes a compression fitting at either end thereof to serve as an electrical terminal and as a hydraulic connector.

8. An electrical conductor as claimed in claim 6 in which said plastic is an epoxy material.

9. An electrical conductor as claimed in claim 6 in which said plastic is a polystyrene material.

10. An electrical conductor as claimed in claim 6 in which said plastic is a silicone rubber material.

* * * * *